US009357863B1

(12) United States Patent
Goenka

(10) Patent No.: US 9,357,863 B1
(45) Date of Patent: Jun. 7, 2016

(54) MATTRESS COVER AND BED SKIRT SYSTEM

(71) Applicant: WELSPUN INDIA LIMITED, Mumbai (IN)

(72) Inventor: Dipali Goenka, Mumbai (IN)

(73) Assignee: Welspun India Limited, Mumbai (IN)

( * ) Notice: Subject to any disclaimer, the term of this patent is extended or adjusted under 35 U.S.C. 154(b) by 0 days.

(21) Appl. No.: 14/837,788

(22) Filed: Aug. 27, 2015

(30) Foreign Application Priority Data

Aug. 14, 2015 (IN) ..... 3092/MUM/2015

(51) Int. Cl.

| | |
|---|---|
| ***A47C 17/00*** | (2006.01) |
| ***A47G 9/02*** | (2006.01) |
| ***A47G 9/04*** | (2006.01) |
| ***A47C 31/10*** | (2006.01) |

(52) U.S. Cl.
CPC ..... *A47G 9/0292* (2013.01); *A47C 31/105* (2013.01); *A47G 9/0238* (2013.01); *A47G 9/04* (2013.01)

(58) Field of Classification Search
CPC ..... A47G 9/0238; A47G 9/0929; A47G 9/04; A47G 9/0223
See application file for complete search history.

(56) References Cited

U.S. PATENT DOCUMENTS

| | | | | |
|---|---|---|---|---|
| 3,694,832 | A | 10/1972 | Jamison | |
| 6,119,290 | A * | 9/2000 | Masoncup | A47G 9/0292 5/482 |
| 8,171,581 | B2 | 5/2012 | Agarwall | |
| 8,566,983 | B2 | 10/2013 | Monaco | |
| 8,627,521 | B2 | 1/2014 | Rowson et al. | |
| 8,640,282 | B2 | 2/2014 | Maguire et al. | |
| 8,689,375 | B2 | 4/2014 | Stinchcomb | |
| 8,707,482 | B1 | 4/2014 | Ramthun | |
| 2002/0088054 | A1 | 7/2002 | McCain et al. | |
| 2004/0031098 | A1 | 2/2004 | Hollander | |
| 2004/0040090 | A1 | 3/2004 | Wootten | |
| 2004/0128764 | A1 * | 7/2004 | McGrath | A47C 21/022 5/499 |
| 2008/0178386 | A1 * | 7/2008 | Thompson | A47G 9/02 5/485 |

* cited by examiner

*Primary Examiner* — David E Sosnowski
(74) *Attorney, Agent, or Firm* — Baker & Hostetler LLP

(57) ABSTRACT

A mattress cover and skirt system includes a skirt configured to be secured to the mattress. The skirt includes a flexible skirt panel defining an upper edge, a lower edge, and an elastic element disposed along at least a portion of the lower edge. The mattress cover system includes a mattress cover panel configured to be removably attached to the skirt. The mattress cover panel includes an upper layer, a lower layer, and a cushioning member disposed between the upper and lower layers. A connector system includes at least one first connector member disposed along the upper edge of the skirt and at least one second connector member disposed proximate the outermost edge of the mattress cover panel. The second connector member is configured to engage the first connector member so as to removably attach the mattress cover panel to the skirt.

29 Claims, 8 Drawing Sheets

MATTRESS COVER AND BED SKIRT SYSTEM

TECHNICAL FIELD

The present disclosure relates to a mattress cover and skirt system, and in particular to a mattress cover that is removably attachable to a skirt.

BACKGROUND

A mattress pad or cover provides an added layer of cushioning and may also serve as a protector for the mattress. Typically, mattress covers include a top panel and side panels or discrete elastic straps that secure the top panel of the cover to the mattress. In some cases, the top panel of the cover includes a fibrous batting or foam encased in textile material. In use, a mattress cover is secured to the top mattress via the side panels (or straps) such that the top panel of the mattress cover overlies the top panel of the mattress. When the cover is in place, bed linens, such as fitted and flat sheets, are placed around the mattress cover.

Mattress covers need to be cleaned. But removing the mattress cover for proper cleaning is cumbersome and timing consuming. For instance, first the bed linens must be removed from the mattress. Then the entire mattress cover is removed from the mattress by removing the side panels from beneath the mattress. If the cover includes side straps, the cover is removed by detaching the straps from the mattress. The mattress cover can then be cleaned as needed per its care instructions. After the mattress cover is cleaned, the cover side panels (or straps) are then placed around the mattress to secure the mattress cover in place. The bed linens are then placed around the clean mattress cover.

SUMMARY

There is a need for a cover system that includes a mattress cover removably attachable to a skirt. Accordingly, an embodiment of the present disclosure is a mattress cover system configured to at least partially cover a mattress that includes a top, a bottom, sides that extend from the top to the bottom, and a top edge where the top and sides intersect. The mattress cover system includes a skirt configured to be secured to the mattress. The skirt includes a flexible skirt panel defining an upper edge, a lower edge, and an elastic element disposed along at least a portion of the lower edge. When the skirt is secured to the mattress, a) the upper edge of the flexible skirt panel is disposed proximate to the top edge of the mattress, and b) the lower edge of the flexible skirt panel is disposed at least partially along the bottom of the mattress. The mattress cover system further includes a mattress cover panel configured to be removably attached to the skirt. The mattress cover panel includes an upper layer, a lower layer opposed to the upper layer, and a cushioning member disposed between the upper and lower layers. The mattress cover panel is sized to cover at least portion of the top of the mattress. The system also includes a connector system including at least one first connector member disposed along the upper edge of the skirt, and at least one second connector member carried by the mattress cover that is configured to engage the at least one first connector member of the skirt so as to removably attach the mattress cover panel to the skirt.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
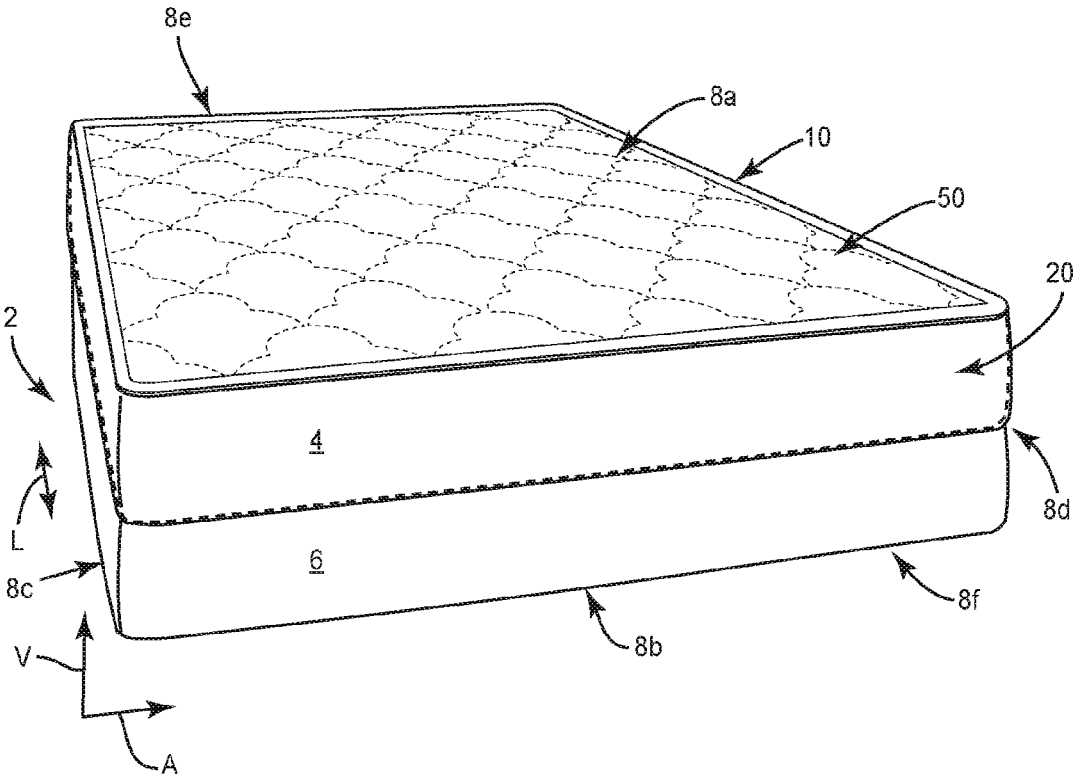
FIG. 1 illustrates a mattress set with a cover system installed one of top mattress, according to an embodiment of the present disclosure.
Figure 2A:
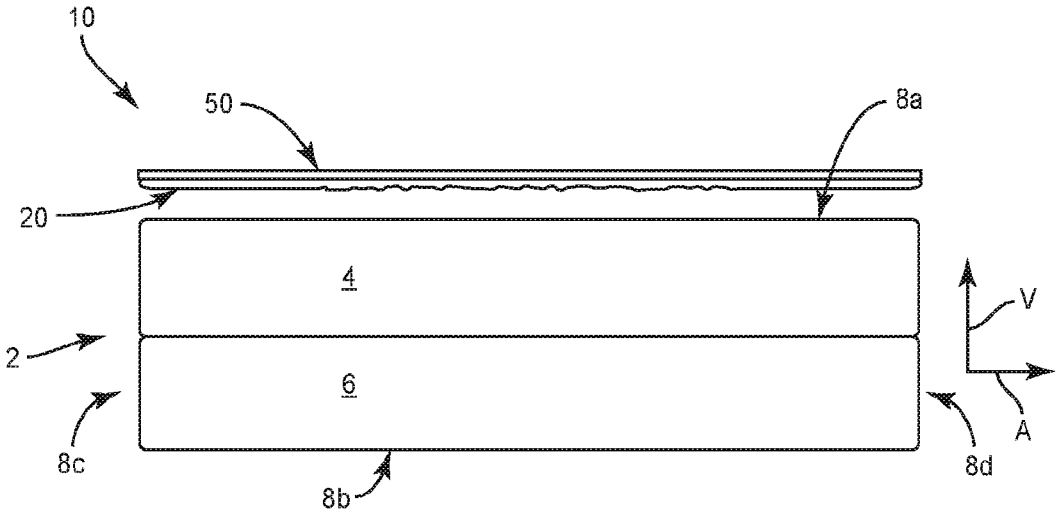
FIG. 2A is an end view of the mattress set shown in FIG. 1 with a cover system removed from the mattress.
Figure 2B:
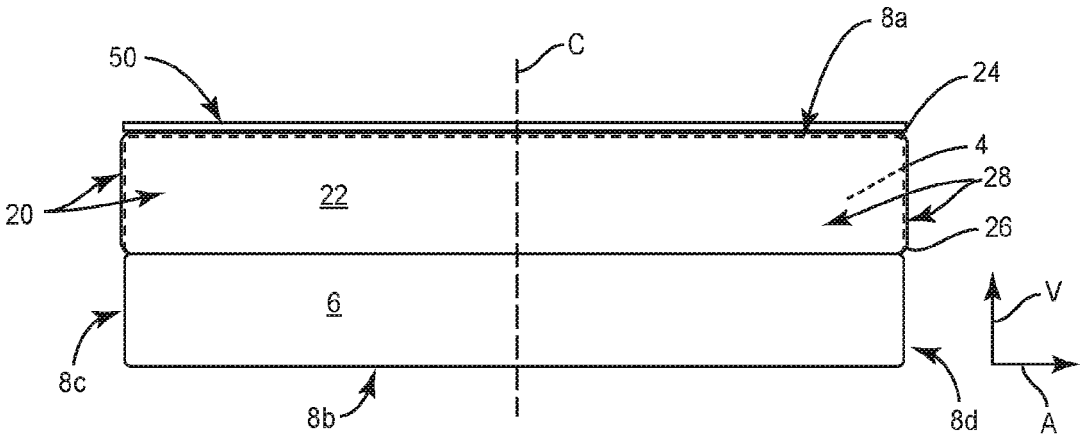
FIG. 2B is an end view of the mattress set and cover system shown in FIG. 1, showing a skirt secured to the sides of the mattress and a cover attached to the skirt the top mattress.
Figure 3A:
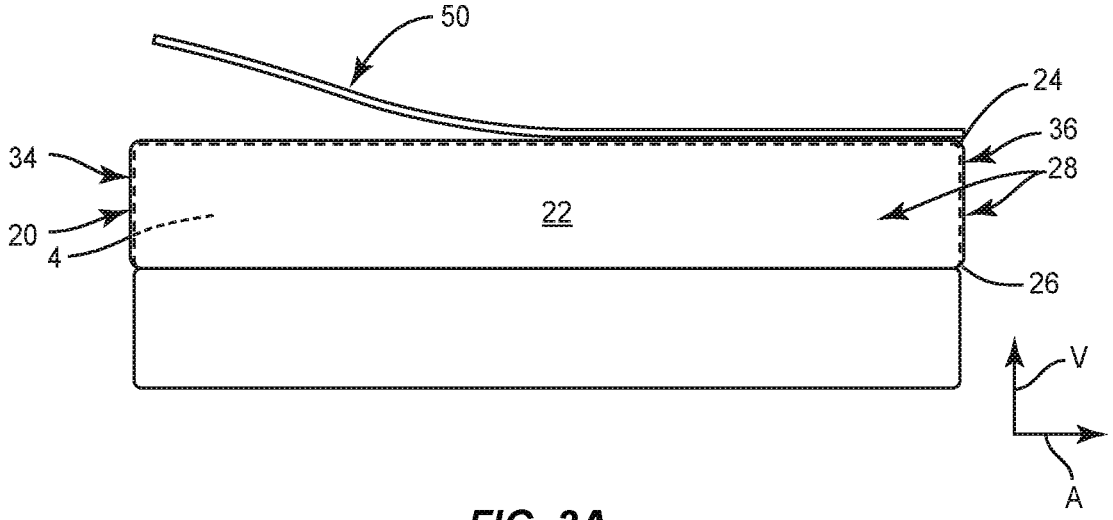
FIG. 3A is an end view of the mattress set shown in FIG. 1, illustrating the cover being removed from the skirt.
Figure 3B:
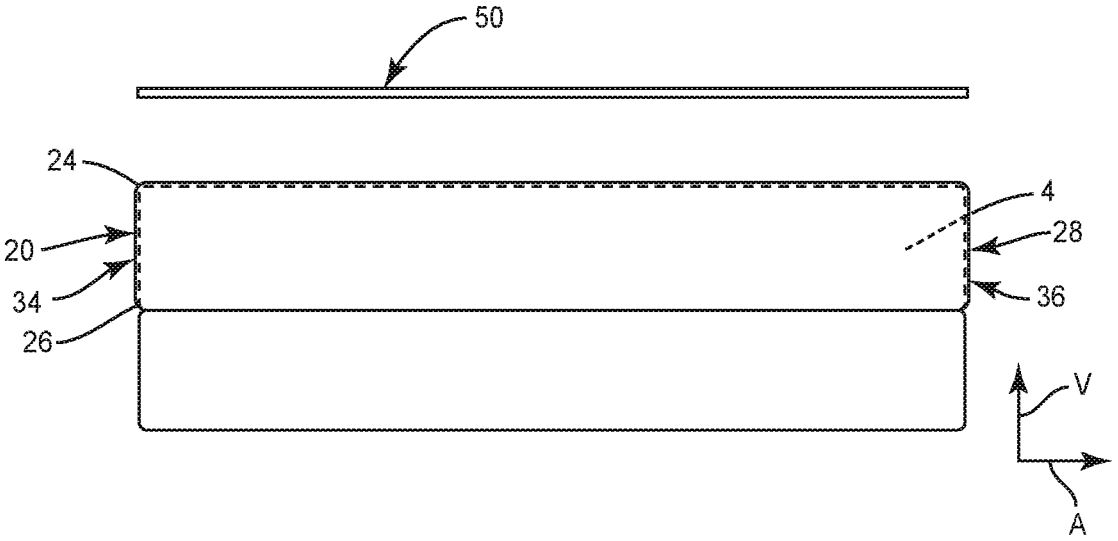
FIG. 3B is an end view of the mattress set shown in FIG. 1, illustrating the cover removed from the skirt.

Embodiments of the present disclosure include a system 10 configured to cover a mattress 4. As shown in FIGS. 1-5, the system 10 includes a mattress cover 50 and a skirt 20 that is removably attached to the mattress cover 50. A user can install the system 10 so that the mattress cover 50 and skirt 20 substantially cover the top and sides of the mattress, as shown in FIG. 1. As needed, the user can detach the mattress cover 50 from the skirt 20 for cleaning, etc., as shown in FIG. 3B. Other embodiments of the disclosure may include a kit whereby different skirts can be used interchangeably with one mattress cover or multiple mattress covers.

FIG. 1 illustrates a mattress set 2 that includes a mattress 4 and box springs 6, and a mattress cover system 10 installed on the mattress 4. The mattress set 2 includes a top 8*a*, a bottom 8*b* spaced from the top 8*a* along a vertical direction V, opposed sides 8*c* and 8*d* spaced apart with respect to each other along a lateral direction A, a head end 8*e* and foot end 8*f* opposed to the head end 8*e* along a longitudinal direction L that is perpendicular to the vertical and lateral directions V and A. The vertical, lateral, and longitudinal directions are orthogonal directional components of the mattress set 2 used for purpose of illustrating embodiments of the mattress cover system 10 applied to the mattress 4.

Turning to FIGS. 1 and 6-9, the mattress cover system 10 includes the skirt 20, the removable mattress cover 50, and a connector system 80. The skirt 20 is configured to be secured to the mattress 4 and removably attached to the cover 50. The skirt 20 generally includes a flexible skirt panel 22, an elastic element 40 and one or more connector members 82 configured to engage with one or connector members 84 of the cover 50. The connector members 82 and 84 define the connector system 80 and will described below. The flexible skirt panel 22 defines an upper edge 24, a lower edge 26, a side portion 28 that extends from the upper edge 24 to the lower edge 26 along the vertical direction V when installed on the mattress (see e.g. FIGS. 2B-3B). The flexible skirt panel 22 further includes a head end 30, a foot end 32 spaced from the head end 30 along the longitudinal direction L, and opposed sides 34 and 36 spaced apart with respect to each other along the lateral direction A. The head end 30, foot end 32, and opposed sides 34 and 36 can be also referred to as the side portion 28 of the flexible skirt panel 22. As illustrated, the skirt panel 22 defines a generally open central region 38 that extends from upper edge 24 to the lower edge 26 along a central axis C. The central axis C is substantially aligned with the vertical direction V when the skirt 20 is attached to the mattress 4. The skirt 20 can therefore defines tubular-like structure that surrounds the head, foot and sides of the mattress 4 but does not substantially cover the top 8*a* of the mattress 4. As noted below, alternative embodiments of the skirt 20 could include a top panel. The skirt further includes a placket 42 secured along the upper edge 24 of the skirt panel 22. The placket 42 includes one or more up to all of the connector members 82. The placket 42 provides some stability along the edge of the skirt panel 22 to aid in mating the connector members 82 and 84 during attachment of skirt 20 to the cover 50.

Figure 4:
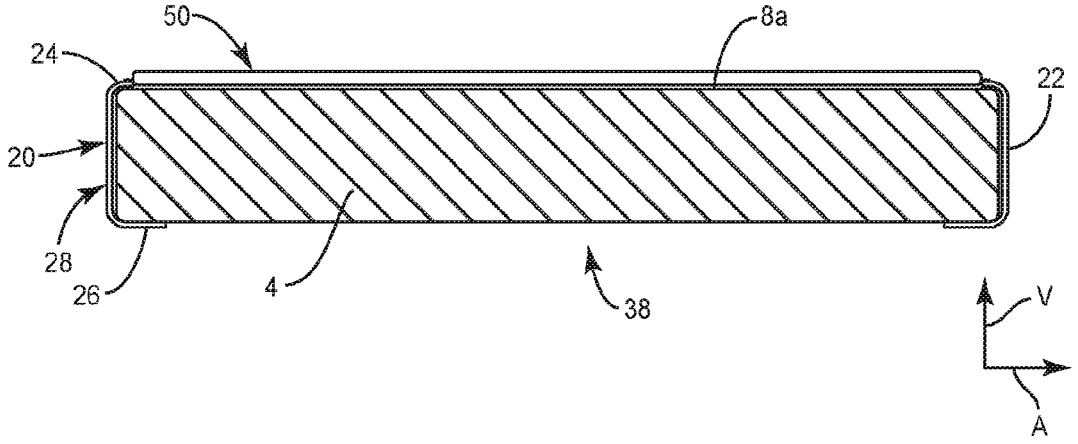
FIG. 4 is a cross-sectional view of the cover system secured to top mattress taken along line 4-4 in FIG. 1, with the box springs removed.
Figure 5:
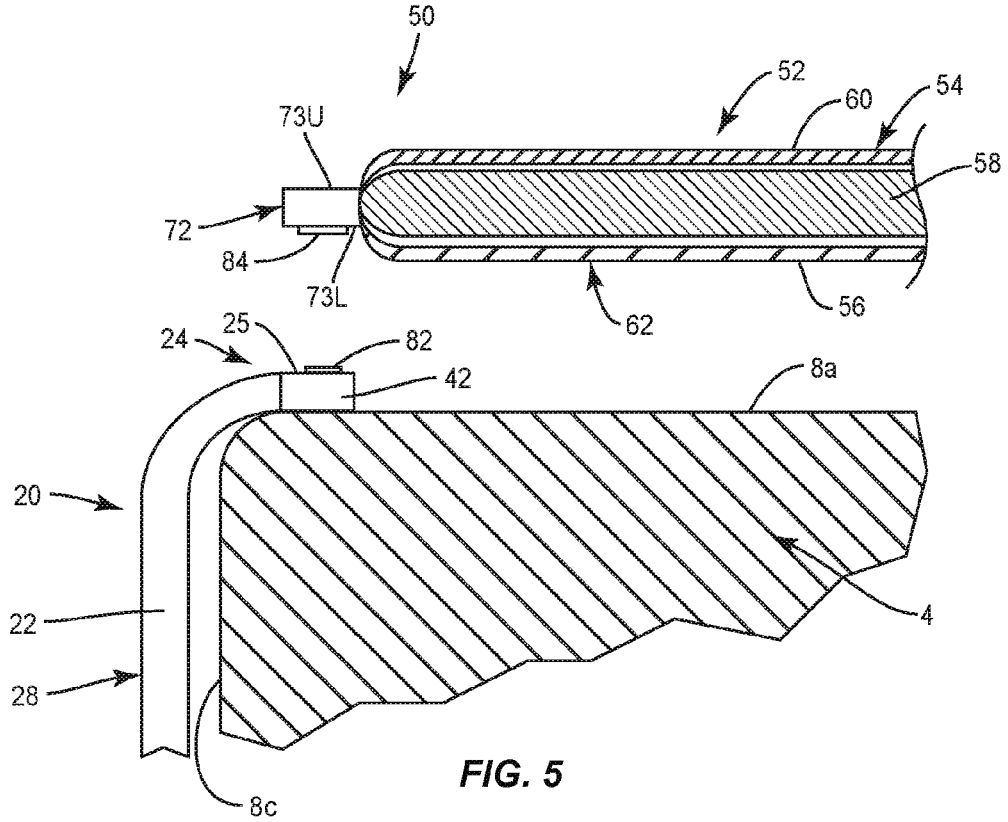
FIG. 5 is a detailed cross-sectional view of the cover system and mattress shown in FIG. 5.
Figure 7:
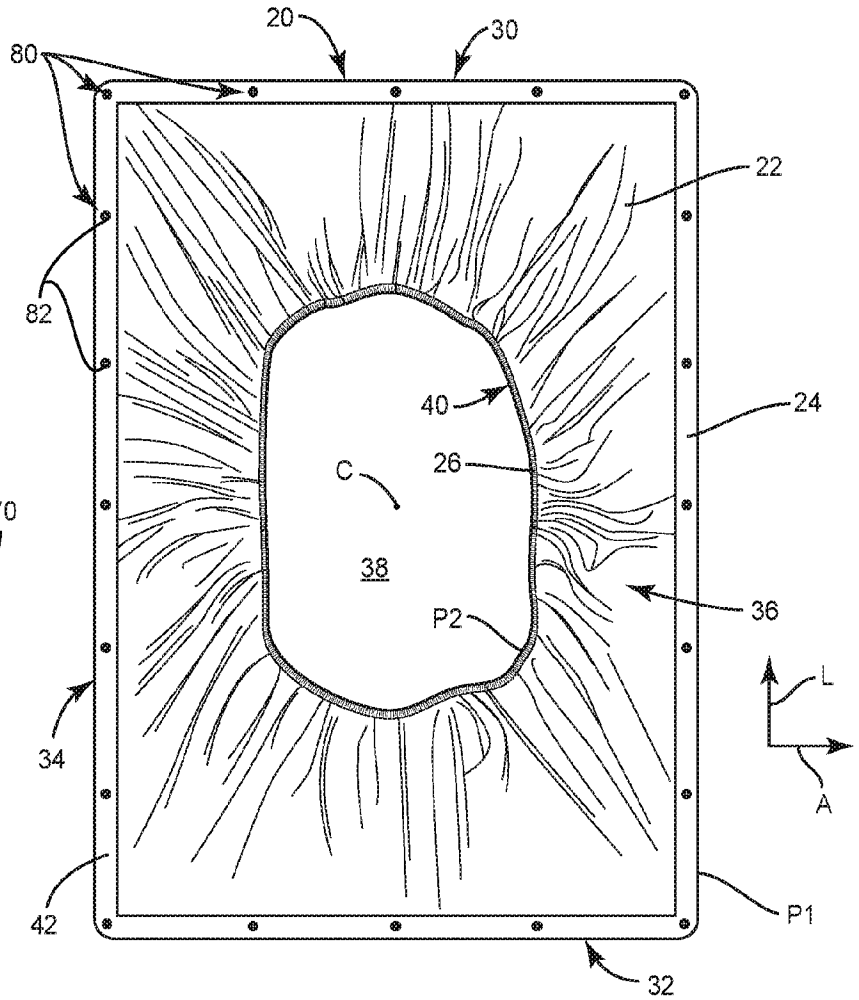
FIG. 7 is a top schematic view of the skirt shown in FIGS. 1-5.

As best shown in FIGS. 4-5 and 7, the skirt 20 has elastic properties that aid in securing the skirt 20 and attached mattress cover 50 in place on the mattress 4. More specifically, skirt 20 includes the flexible skirt panel 22 formed from a textile material with stretch and recovery properties. In addition, the elastic element 40 is disposed at least partially along the lower edge of the flexible skirt panel 22. The elastic element 40 can be a rubberized material, elastic webbing or cord. The result is a skirt 20 with a first relaxed configuration where the elastic element 40 draws the lower edge of the flexible skirt panel 22 inwardly toward the central axis C of the skirt 20, and a second installed configuration where the flexible skirt panel 22 is stretched outwardly away from the central axis C as to fit around sides portion of the mattress. It can be said that the upper edge 24 of the flexible skirt panel 22 defines a first perimeter P1, and the lower edge 26 of the skirt panel defines a second perimeter P2 that is less than the first perimeter P1 when the skirt 20 is in the first relaxed configuration. The elastic element 40 is configured to permit adjustment of the second perimeter P2 so as fit the lower edge 26 around a portion of the bottom of the mattress 4.

In one example, the textile material that forms the flexible skirt panel 22 is a knit fabric. The knit fabric may be a weft knit, such as single jersey knit fabric, a double knit, rib knit, or any other type of weft knitted fabric. The knit fabric may alternatively be a warp knit, such as tricot or Rachel warp knitted fabric. The knit fabric defining the flexible skirt panel can be formed from any number of yarn types, such a spun yarns or continuous filament yarns. Spun yarns may be include natural fibers, synthetic fibers, or blends of natural and synthetic fibers. To improve elastic recovery properties, elastomeric components may be inlaid into the knit fabric during fabric formation or during yarn formation. In one example, the flexible skirt panel 22 is a weft knitted fabric formed with spun cotton yarns and/or spun cotton and polyester blended yarns. In an alternative embodiment, the textile material forming the flexible skirt panel 22 is a woven fabric that includes elastic recovery properties, such as a woven fabric formed with a substantial amount of elastomeric yarns. In still other alternative embodiments, the textile material forming the flexible skirt panel 22 is a nonwoven fabric, such as a stitch bonded fabric with one or more elastomeric components to improve the stretch and recovery characteristics of the flexible skirt panel 22. It should be appreciated that the textile material forming the flexible skirt panel can be a structure of one or more layers of a knit, woven, or nonwoven materials with sufficient stretch and recovery properties that allows the flexible skirt panel to expanded outwardly to a size that allows a user to place the skirt around the mattress yet have sufficient recovery properties so that the flexible skirt panel forms a tight, close fit around the mattress when in an installed configuration.

As discussed above, in an alternative embodiment, the skirt 20 includes a top panel (not shown) attached to the upper edge 24 to substantially close off the central region 38 and thus the top 8*a* of the mattress 4 when the secured to the mattress. When the skirt 20 includes a top panel, the mattress cover 50 is substantially parallel to the top panel (not shown) when the mattress cover 50 is attached to the skirt 20. The top panel can be woven, knit, or nonwoven fabric formed from natural or synthetic fibers, or both natural and synthetic fibers.

Furthermore, the skirt 20 may include one or more additional attachment members (not shown) that are configured to help secure the skirt 20 to the mattress 4. For instance, the attachment members may be configured as elastic straps that traverse the corners of the skirt. Such attachment members may be suitable when the skirt 20 is generally open and does not include a top panel as described above.

Figure 6:
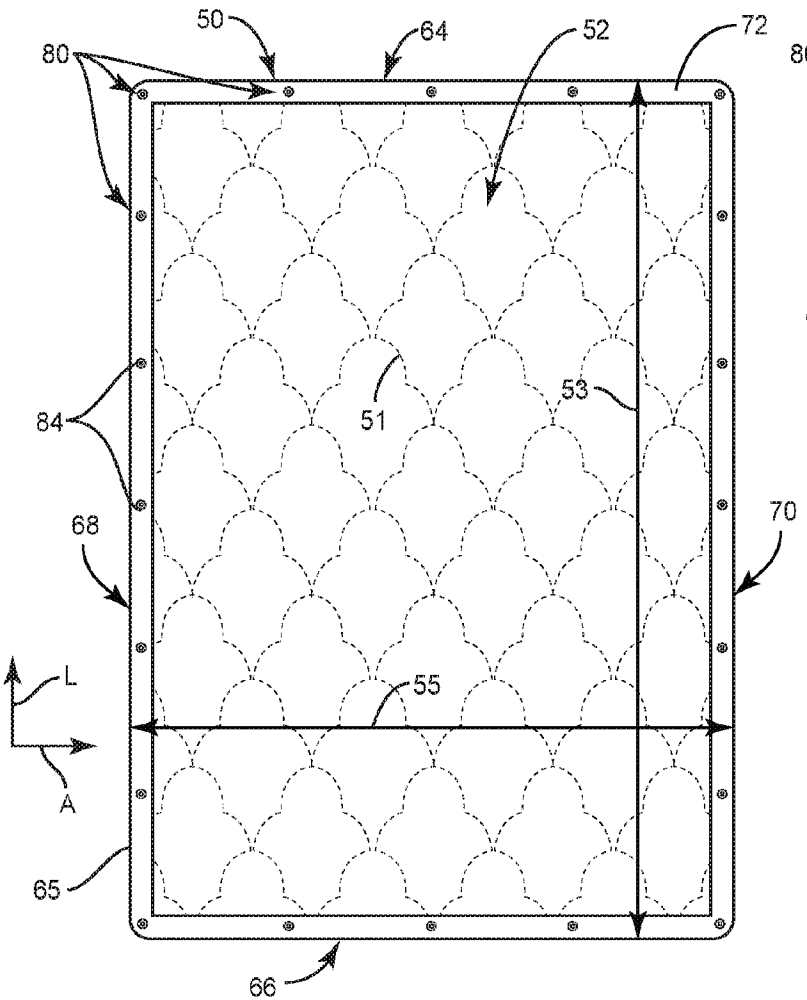
FIG. 6 is a bottom schematic view of the mattress cover shown in FIGS. 1-5.
Figure 9:
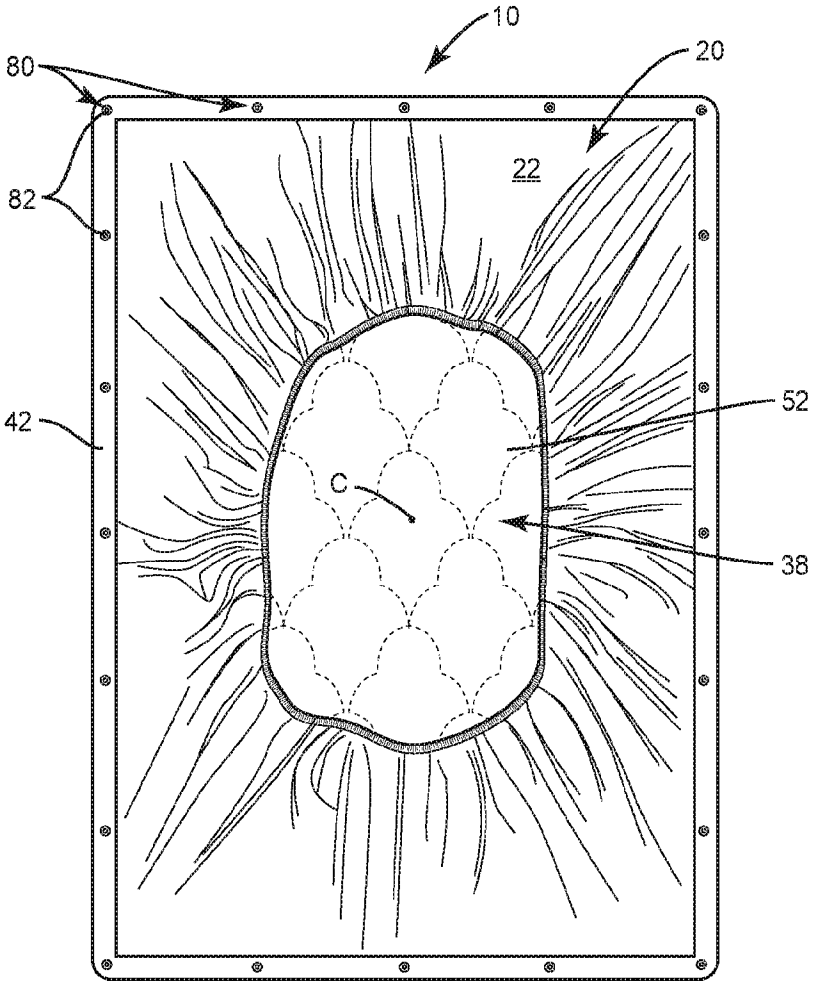
FIG. 9 is a bottom schematic view of the cover system shown in FIGS. 1-5.
Figure 8:
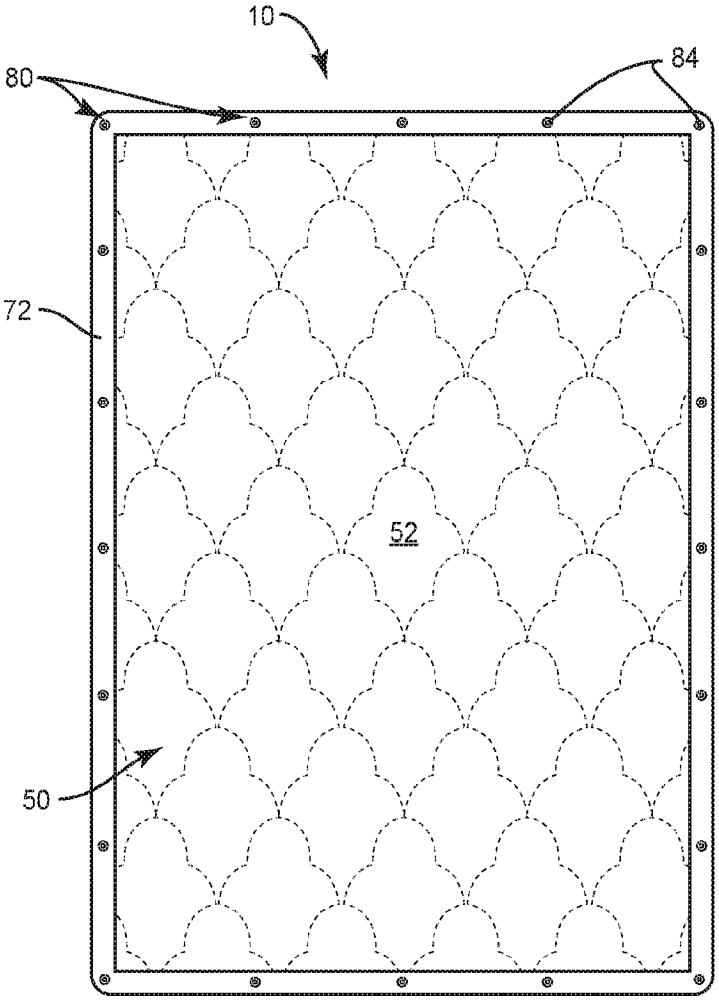
FIG. 8 is a top schematic view of the cover system shown in FIGS. 1-5.
Figure 10:
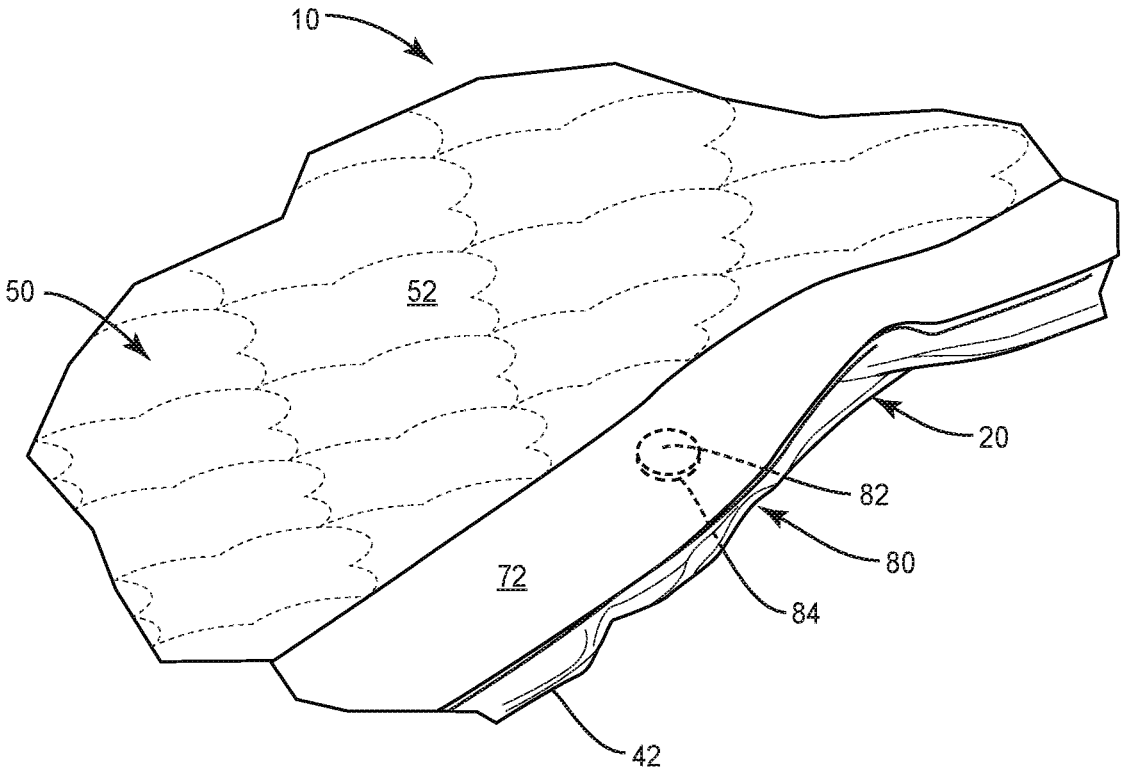
FIG. 10 is a top perspective view of a portion of the cover system shown in FIG. 8.
Figure 11:
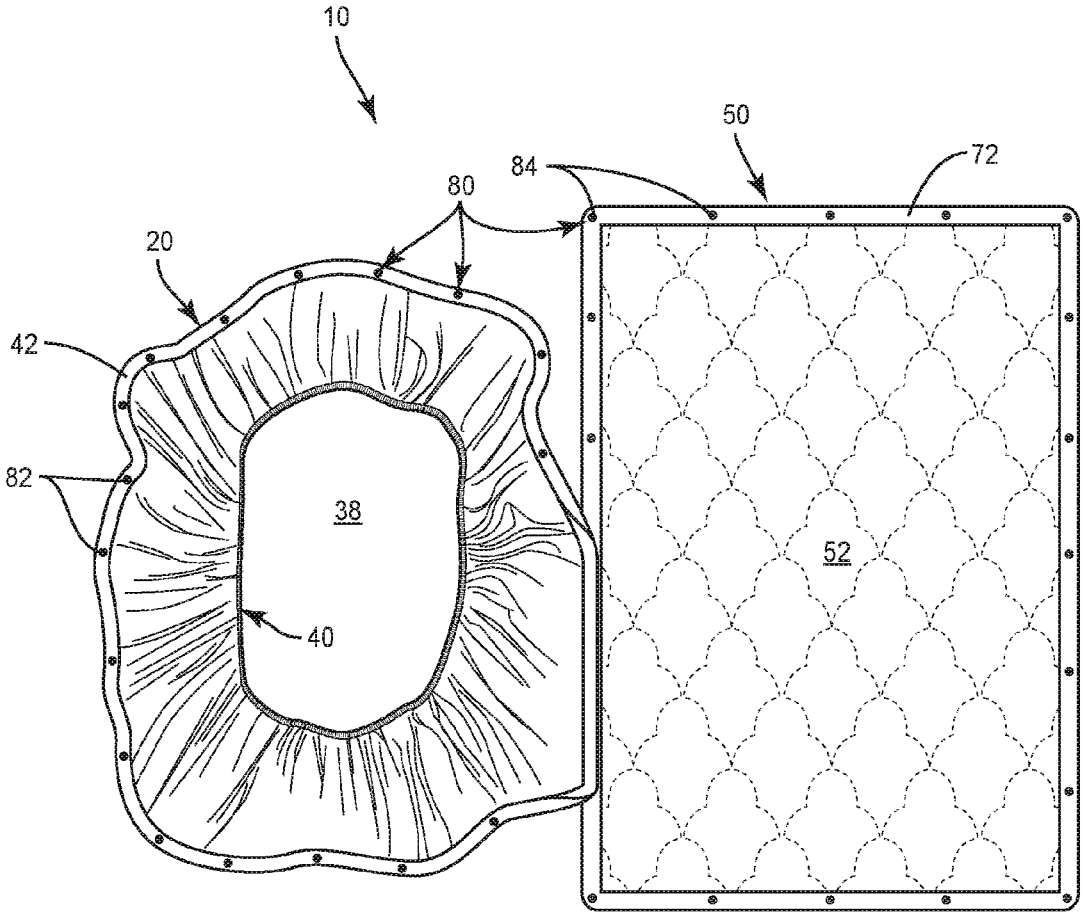
FIG. 11 is a bottom schematic view of the cover system illustrating partial detachment of the cover from the skirt.

Turning to FIGS. 5 and 6, the cover 50 is configured to overly the top panel of the mattress when the system is installed. The mattress cover 50 includes cover panel 52 that includes an upper layer 54, a lower layer 56 opposed to the upper layer 54, and a cushioning member 58 disposed between the upper and lower layers 54 and 56. The upper layer 54 can define an outer surface 60 that faces away from the mattress 4 and the lower layer 56 can define a lower surface 62 that opposed to the outer surface 60 and faces the mattress 4. Thus, the outer surface 60 and the lower surface 62 can be spaced apart with respect to each along the vertical direction V. The cover panel 52 further includes a head end 64, a foot end 66 spaced from the head end 64 along the longitudinal direction L to define a length 53, and opposed sides 68 and 70 spaced apart with respect to each other along the lateral direction A to define a width 55. The cover panel 52 further defines outermost edge 65, which defines an outermost perimeter of the cover 50. As illustrated, the mattress cover panel is sized to cover at least portion of the top 8*a* of the mattress 4. The cover panel 52 further includes a placket 72 disposed along at least a portion (up to all) of the outer most edge. The placket 72 may include an upper surface 73*u* and a lower surface 731 that generally correspond to the upper surface 60 and lower surface 62 of the upper and lower layers. The placket 72 may be configured as a hem that partially secures the upper layer, lower layer and cushioning members together.

The upper and lower layers 54 and 56 can be formed from one or more textile materials. The textile materials that form the upper and lower layers can be woven, knit, or nonwoven fabrics. As needed, additional films or barriers may be included in the upper and/or lower layers.

The textile materials may be a woven fabric, such as a plain weave, satin/sateen, twill, basket weave, or any other suitable woven construction. Woven fabrics can include synthetic warp and weft yarns, natural or blended warp and weft yarns, synthetic warp yarns with natural and/or blended weft yarns, natural warp yarns with synthetic weft yarns. The textile material may also include a knit fabric. The knit fabric may be a weft knit, such as single jersey knit fabric, a double knit, rib knit, or any other type of weft knitted fabric. The knit fabric may alternatively be a warp knit, such as a tricot or rachel warp knitted fabric.

Woven or knit textile materials forming the upper and lower layers can be formed from any number of yarn types, such a spun yarns or continuous filament yarns. Spun yarns may include natural fibers, synthetic fibers, or blends of natural and synthetic staple fibers. Natural fibers include cotton, wool or others. Synthetic fibers may include polyethylene terephthalate (PET), viscose rayon, acrylic, or other fiber types, such a flame resistance fibers as needed. Suitable thermoplastic synthetic staple fibers may be mono-component or bi-component type fibers. A variety of yarn spinning types can be used, such as ring spun, open end, air-jet, and the like. Spun yarns can therefore include spun cotton yarns and/or spun cotton and polyethylene terephthalate (PET) blended yarns. Continuous filaments yarns may include either or both mono-component or bicomponent filaments types. Continuous filament yarns can be polyethylene terephthalate, polyolefin, and/or polyamide 6, polyamide 6,6, polylactic acid filaments.

The textile material may also be a nonwoven fabric. Suitable nonwoven fabrics, include melt-spun nonwovens, such as spunbond and meltblown materials. A meltspun nonwoven can include a single spunbond layer, multiple spunbond layers, a single meltblown layer, multiple meltblown layers, or multiple layers of spunbond and meltblown materials. Meltspun nonwovens can from with polyethylene terephthalate, polyolefin, and/or polyamide 6, polyamide 6,6, or polylactic acid polymers. Alternatively, the nonwoven fabrics can be carded or airlaid materials that are bonded thermally, chemically, and/or mechanically, e.g. via needles or stitch bonding. Suitable fibers is carded or airlaid materials include PET and viscose fibers, and the like.

The textile materials forming the upper and lower layers can be formed from one or more layers of textiles materials that include a number of functional finishes, coatings, or other treatments that enhance functionality of the cover 50. For instance, the upper layer can include anti-bacterial agents, coatings, flame retardant coatings, and the like. Furthermore, the textile materials may include barriers, such as films or other materials that can help inhibit penetration of particles through the cover into to the mattress.

The textile material forming the upper layer can be formed from either one of a woven, knit, or nonwoven fabric. Furthermore, one or more woven, knit, and nonwoven fabrics can define the upper layer. For instance, the upper layer can include multiple woven fabric layers configured as a laminate. Alternatively the upper layer can be a laminate of a woven and nonwoven fabric, a knit and nonwoven fabric, or even a woven and knit fabric. Likewise, the textile material forming the lower layer can be formed from either one of a woven, knit, or nonwoven fabric. Furthermore, one or more woven, knit, and nonwoven fabrics can define the lower layer. In one example, the lower layer can include multiple woven fabric layers configured as a laminate. The lower layer could also be laminate of a woven and nonwoven fabric, a knit and nonwoven fabric, or even a woven and knit fabric.

The cushioning member 58 is configured to add loft and cushion to the cover. In one example, the cushioning member is a fibrous batting disposed between the upper and lower layers. For instance, the cushioning member can be an assembly of cut fibers arranged to provide loft and compression resilience to the cover 50. Any suitable fiber type can be used. In one example, polyester fibers are used as the fibrous batting. The fibrous batting can be a loosely arranged without any specific bonding structure securing the fibers together. Alternatively, the fibrous batting can be air-laid nonwoven materials with either an adhesive or hot-melt bonding mechanisms used to provide structural integrity. In an alternative embodiment, the cushioning member can a closed cell or open cell foam, such as natural or synthetic latex, or other foam types. In still other embodiments, the cushioning member can be down, such as a combination of down feather and other feathers.

As illustrated the cover 50 is quilted so as to secure the upper layer to the lower layer. As illustrated, the cover 50 includes quilt lines 51 that secure the upper layer 54 to the lower layer 56 and define pockets therebetween that house the cushioning member 58. The quilt pattern can be varied as needed to help secure the layers 54 and 56 together, impact loft and compression, and/or aesthetics of the cover 50. Furthermore, and as described above, the placket 72 may be configured as a hem that secures the upper layer 54, lower layer 56 and cushioning member 58 together along the outer edge 65 of the cover panel 52.

In one preferred example, the upper layer 54 of the cover panel 52 includes a woven fabric formed with PET yarns, the lower layer 56 is a nonwoven fabrics, and the cushion, is a fibrous batting.

The mattress cover system 10 includes a connector system 80 that removably attaches the skirt 20 to the cover 50. As illustrated, the connector system 80 includes a first connector member 82 carried by the skirt 20 and a second connector member 84 carried by the removable cover 50. The first and second connector members 82 and 84 are configured to selectively engage with each other so as to selectively, removably attached the skirt 20 and cover 50. As illustrated, the first connector member 82 is disposed along the upper edge 24 of flexible skirt panel 22, and specifically located along the placket 42. The second connector member 84 is disposed along the outer edge 65 of the cover 50, also disposed along its placket 72. Accordingly, the first connector member 82 is referred to as the skirt connector member and the second connector member 84 is referred to as the cover connector member. In accordance with the embodiment shown in the figures, the connector system 80 comprises snap fasteners. The skirt 20 includes a plurality of connector members 82 configured as male snap components of the snap fasteners. The cover 50 includes a plurality of connector members 84 configured as the female component of the snap fasteners. The cover 50 could also be configured to include the female component of the snap fasteners and the skirt could include the male component of the snap fasteners. For instance, as shown in FIG. 4, the first connector member 82 may include one or more male components disposed along an outer surface 25 of the upper edge 24 (or placket) of the skirt 20. The second connector member 84 may include female components disposed along a lower surface 731 of the placket 72 proximate the outer edge of the cover 50. When the cover 50 is placed over the mattress 4, the outer surface 25 of the skirt 20 faces upwardly such that male components of the snap fastener are positioned to engage the female components of the snap fasteners located on the lower surface 62 of the cover 50. This arrangement allows the cover 50 to sit flat on the mattress top without having to fold the plackets 42 and 72 over so that the connectors can be connected to each other.

Other connector systems can be used to removably attach the cover 50 to the skirt 20. For instance, the connector system 80 may be a zipper system. In such an embodiment, the first connector member 82 is a first portion of the zipper and the second connector member 84 is a second portion of the zipper. The zipper portions can be arranged on plackets 42 and 72 such that the cover 50 lies flat with respect to the mattress and skirt 20 along its outer edge 65.

In another embodiment, the connector system 80 could also be a hook and loop system. For instance, the first connector member 82 may include one or more hook panels disposed along the outer surface 25 of the upper edge 24 (or placket) of the skirt 20 (See FIG. 5). The second connector member 84 may include one or more loop panels disposed along the lower surface 731 of the placket 72 proximate the outer edge 65 of the cover 50. The loop panels can be disposed in locations that correspond to the locations of the hook panels of the skirt 20. When the cover 50 is placed over the mattress 4, the outer surface 25 of the skirt 20 faces upwardly such that hook panels receives the loop panels located on the lower surface of the cover 50. While the hook panels are described as being secured to the skirt 20 and the loop panels are secured to the cover, the hook panels could be secured to the cover 50 and the loop panels could be secured to the skirt 20. The hook and loop system can include elongate panels that extend along substantial majority of the edges of the skirt 20 or cover 50.

In another embodiment, the connector system 80 could also be a grommet and toggle system. For instance, the first connector member 82 may include one or more grommets disposed along the the upper edge 24 (or placket) of the skirt 20. The second connector member 84 may include one or more toggles positioned along the outer edge of the cover 50 in locations that correspond to the locations of the grommets on the skirt 20. When the cover 50 is placed over the mattress 4, the grommets align with and can receive the toggles therethrough. While the grommets are described as being disposed along the skirt 20 and the toggles are secured to the cover 50, the grommets could be disposed along the cover 50 and the toggles could be secured to the skirt 20.

In another embodiment, the connector system 80 could also be a system of ties. For instance, the first connector member 82 may include a plurality of first ties disposed along the upper edge 24 (or placket) of the skirt 20. The second connector member 84 may include a plurality of second ties positioned along the outer edge of the cover 50 in locations that correspond to the locations of the first ties on the skirt 20. When the cover 50 is placed over the mattress 4, the first and second ties align and can be tied together to secure the cover to the skirt 20.

In still other embodiments, the connector system 80 can be a button system. For instance, the first connector member 82 may include a plurality of buttons disposed along the upper edge 24 (or placket) of the skirt 20. The second connector member 84 may include a plurality of button holes positioned along the outer edge of the cover 50 in locations that correspond to the locations of the buttons of the skirt 20. It should be appreciated that the either skirt 20 or the cover 50 can include the buttons and that either the skirt 20 or the cover 50 can include button holes.

As shown in FIGS. 3A-5 and 11, the system 10 can be packaged with the cover 50 attached to the skirt 20. The user can then expand the lower edge 26 of the skirt around the mattress such at the lower edge 26 extends partially beneath and along the mattress bottom. As needed, such as when the cover 50 needs to be cleaned, the user can decouple the first and second connector members 82 and 84 from each other so as to detach the cover 50 from the skirt 20. Access to the connector system 80 along the outer edge 65 of the cover 50 and upper edge 24 of the skirt panel 22 makes it easy for the user to decouple the connector 82 and 84 from each other. After the cover 50 is detached from the skirt 20 (FIG. 3B), the user can wash the cover 50. A second, or additional, cover 50' can be attached to the installed skirt 20.

While the disclosure is described herein using a limited number of embodiments, these specific embodiments are not intended to limit the scope of the disclosure as otherwise described and claimed herein. The precise arrangement of various elements and order the steps of articles and methods described herein are not to be consider limiting. For instance, although the steps of the methods are described with reference to sequential series of reference signs and progression of the blocks in the figures, the method can be implemented in a particular order as desired.

What is claimed:

1. A mattress cover system configured to at least partially cover a mattress that includes a top, a bottom, sides that extend from the top to the bottom, and a top edge where the top and sides intersect, the mattress cover system comprising:

a skirt configured to be secured to the mattress, the skirt including a flexible skirt panel defining an upper edge, a lower edge, and an elastic element disposed along at least a portion of the lower edge, the skirt further including a skirt placket disposed along at least a portion of the upper edge of the flexible skirt panel, the skirt placket defining an upper surface, a lower surface opposite to the upper surface, a first thickness that extends from the lower surface to the upper surface, wherein when the skirt is secured to the mattress, a) the upper edge of the flexible skirt panel is disposed proximate to the top edge of the mattress, and b) the lower edge of the flexible skirt panel is disposed at least partially along the bottom of the mattress;

a mattress cover panel sized to cover at least a portion of the top of the mattress and configured to be removably attached to the skirt, the mattress cover panel including an upper layer, a lower layer opposite to the upper layer, an outermost edge, and a mattress cover panel thickness that extends from the upper layer to the lower layer, the mattress cover panel further including a mattress cover placket disposed along at least a portion of the outermost edge, the mattress cover placket defining an upper surface, a lower surface opposite to the upper surface of the mattress cover placket, and a second thickness that extends from the upper surface of the mattress cover placket to the lower surface of the mattress cover placket, wherein the mattress cover panel thickness is greater than the first thickness and the second thickness; and a connector system including at least one first connector member disposed along at least a portion of the upper surface of skirt placket, and at least one second connector member disposed along at least a portion of the lower surface of the mattress cover placket, the at least one second connector member being configured to engage the at least one first connector member so as to removably attach the mattress cover panel to the skirt, wherein when the mattress cover panel is attached to the skirt via the connector system, the mattress cover placket lays flat with respect to the skirt placket.

2. The system of claim 1, wherein the skirt has a first relaxed configuration where the elastic element draws the lower edge of the flexible skirt panel inwardly toward a central axis of the skirt, and a second installed configuration where the flexible skirt panel is stretched outwardly away from the central axis as to fit around a portion of the mattress.

3. The system of claim 1, wherein the skirt includes a top panel that is secured to the upper edge of the flexible skirt panel, such that the mattress cover panel is substantially parallel to the top panel when the mattress cover panel is attached to the skirt.

4. The system of claim 1, wherein the flexible skirt panel is a knit fabric.

5. The system of claim 1, wherein each of the upper layer and the lower layer includes at least one layer of a textile material.

6. The system of claim 5, wherein the textile material is a woven fabric, a knit fabric, or a nonwoven fabric.

7. The system of claim 1, wherein the first connector member is a first portion of a zipper and the second connector member is a second portion of the zipper.

8. The system of claim 1, wherein one of the at least one first connector member and the at least one second connector member is a hook panel and the other of the at least one first connector member and the at least one second connector member is a loop panel such that the at least one first and second connector members define a hook and loop connector system.

9. The system of claim 1, wherein one of the at least one first connector member and the at least one second connector member is a male component of a snap fastener and the other of the at least one first connector member and the at least one second connector member is a female component of the snap fastener.

10. The system of claim 1, wherein one of the at least one first connector member and the at least one second connector member is a grommet and the other of the at least one first connector member and the at least one second connector member is a toggle that fits through the grommet.

11. The system of claim 1, wherein one of the at least one first connector member and the at least one second connector member is a button and the other of the at least one first connector member and the at least one second connector member is a button hole sized to receive the button.

12. The system of claim 1, wherein the first connector member and the second connector member are first and second ties, respectively, the first and second ties configured to be tied to each other so as to secure mattress cover panel to the skirt.

13. A mattress cover system configured to at least partially cover a mattress that includes a top, a bottom, sides that extend from the top to the bottom, and a top edge where the top and sides intersect, the mattress cover system comprising:

a skirt configured to be secured to the mattress, the skirt including a knit panel defining an upper edge, a lower edge, a side portion that extends from the upper edge to the lower edge, a skirt placket disposed along at least a portion of the upper edge, and an elastic element disposed along at least a portion of the lower edge, the skirt placket defining an inner edge and an outer edge opposite to the inner edge, the skirt further including a first connector member disposed along at least a portion of the skirt placket, wherein when the skirt is secured to the mattress, a) the upper edge of the flexible skirt panel is disposed proximate to the top edge of the mattress, b) the side portion extends along the sides of the mattress, and c) the lower edge of the flexible skirt panel is disposed at least partially along the bottom of the mattress; and a mattress cover panel sized to cover at least portion of the top of the mattress and configured to be removably attached to the skirt, the mattress cover panel including an upper textile layer, a lower textile layer opposite to the upper textile layer, an outermost edge, and a mattress cover placket disposed along at least portion of the outermost edge, the mattress cover placket defining an inward edge and an exterior edge opposite to the inward edge, the mattress cover panel further including a second connector member disposed along at least a portion of the mattress cover placket, the second connector member being configured to engage the first connector member so as to removably attach the mattress cover panel to the skirt, wherein when the second connector member is engaged with the first connector member so that mattress cover panel is attached to the skirt, the outer edge of the skirt placket does not extend inwardly further than the inward edge of the mattress cover placket.

14. The system of claim 13, wherein the skirt has a first relaxed configuration where the elastic element draws the lower edge of the flexible skirt panel inwardly toward a central axis of the skirt, and a second installed configuration where the flexible skirt panel is stretched outwardly away from the central axis as to fit around a portion of the mattress.

15. The system of claim 13, wherein the knit panel is a warp knit.

16. The system of claim 13, wherein the knit fabric is a weft knit.

17. The system of claim 13, wherein the knit panel is formed from one or more yarns that include polyester fibers.

18. The system of claim 13, wherein the upper textile layer is a woven fabric, the lower textile layer is a nonwoven fabric, and the cushioning member is a fibrous batting.

19. The system of claim 1, wherein the mattress cover panel further comprises a cushioning member disposed between the upper layer and the lower layer.

20. The system of claim 1, wherein the first thickness is substantially equal to the second thickness.

21. The system of claim 1, wherein the at least one first connector member is connected directly to the upper surface of the skirt placket, and the at least one second connector member is connected directly to the lower surface of the mattress cover placket.

22. The system of claim 1, wherein the skirt placket further comprises an inner edge and an outer edge opposite to the inner edge; and the mattress cover placket further comprises an inward edge and an exterior edge opposite to the inward edge, wherein when the second connector member is engaged with the first connector member so that the mattress cover panel is attached to the skirt, the outer edge of the skirt placket does not extend inwardly further than the inward edge of the mattress cover placket.

23. The system of claim 13, wherein the mattress cover panel further comprises a cushioning member disposed between the upper layer and the lower layer.

24. The system of claim 13, wherein the skirt placket further comprises an upper surface, a lower surface opposite to the upper surface, and a first thickness that extends from the lower surface to the upper surface;

the mattress cover placket further comprises an upper surface, a lower surface opposite to the upper surface of the mattress cover placket, and a second thickness that extends from the upper surface of the mattress cover placket to the lower surface of the mattress cover placket; and the mattress cover panel further comprises a mattress cover panel thickness that extends from the upper layer to the lower layer, wherein the mattress cover panel thickness is greater than the first thickness and the second thickness.

25. The system of claim 24, wherein the first thickness is substantially equal to the second thickness.

26. The system of claim 13, wherein the first connector member is connected directly to the upper surface of the skirt placket, and the second connector member is connected directly to the lower surface of the mattress cover placket.

27. The system of claim 20, wherein the flexible skirt panel further comprises an inner surface, an outer surface opposite to the inner surface, and a skirt thickness that extends from the inner surface to the outer surface, wherein the skirt thickness is substantially equal to the first thickness.

28. The system of claim 19, wherein the cushioning member includes at least one of a fibrous batting, a foam material, and an assembly of down.

29. The system of claim 23, wherein the cushioning member includes at least one of a fibrous batting, a foam material, and an assembly of down.

* * * * *